US008966763B1

(12) United States Patent
Heck

(10) Patent No.: US 8,966,763 B1
(45) Date of Patent: Mar. 3, 2015

(54) TOOLING SYSTEM FOR PROCESSING WORKPIECES

(75) Inventor: David P. Heck, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 816 days.

(21) Appl. No.: 12/843,420

(22) Filed: Jul. 26, 2010

(51) Int. Cl.
*B21D 53/88* (2006.01)
*B25B 1/24* (2006.01)

(52) U.S. Cl.
USPC ..... 29/897.2; 269/266; 219/656

(58) Field of Classification Search
CPC ..... B21D 37/02; B21D 37/06; B23Q 1/03–1/037; B28B 7/025
USPC ..... 269/266, 53; 72/413, 412, 416, 411; 219/656; 29/897.2
See application file for complete search history.

(56) References Cited

U.S. PATENT DOCUMENTS 3,559,447 A * 2/1971 Bogart ..... 72/342.4
5,546,784 A * 8/1996 Haas et al. ..... 72/413
5,954,175 A * 9/1999 Haas et al. ..... 192/48.2
6,089,061 A * 7/2000 Haas et al. ..... 72/14.8
6,209,380 B1 * 4/2001 Papazian et al. ..... 72/413
6,415,191 B1 * 7/2002 Pryor ..... 700/95
6,578,399 B1 * 6/2003 Haas et al. ..... 72/57
6,644,637 B1 * 11/2003 Shen et al. ..... 269/152
6,925,346 B1 * 8/2005 Mazumder et al. ..... 700/119
6,993,948 B2 2/2006 Offer
7,055,679 B2 * 6/2006 Shen et al. ..... 198/867.08
7,073,561 B1 * 7/2006 Henn ..... 164/94
7,286,893 B1 10/2007 Mazumder
7,610,790 B2 11/2009 Halford
7,703,190 B2 * 4/2010 Halford ..... 29/557
2005/0109590 A1 * 5/2005 Shen et al. ..... 198/867.08
2008/0016938 A1 1/2008 Halford
2008/0122152 A1 5/2008 Halford
2008/0203640 A1 * 8/2008 Halford ..... 269/266
2009/0020936 A1 1/2009 Halford
2009/0056517 A1 3/2009 Halford
2009/0250857 A1 * 10/2009 Halford ..... 269/55

* cited by examiner

*Primary Examiner* — Jacob Cigna
(74) *Attorney, Agent, or Firm* — Yee & Associates, P.C.

(57) ABSTRACT

A method and apparatus for manufacturing an object. A plurality of elements may be positioned to substantially conform to a surface on a first side of a workpiece. The plurality of elements may be heated, while the plurality of elements is substantially conformed to the surface on the first side of the workpiece. A material may be deposited on the workpiece while heating the plurality of elements.

18 Claims, 14 Drawing Sheets

TOOLING SYSTEM FOR PROCESSING WORKPIECES

BACKGROUND INFORMATION

1. Field

The present disclosure relates generally to manufacturing and, in particular, to a method and apparatus for processing workpieces. Still more particularly, the present disclosure relates to a method and apparatus for depositing materials on a workpiece.

2. Background

In manufacturing aircraft, different structures may be assembled to form the aircraft. These structures may be assembled from different parts. For example, without limitation, I-beams, skin panels, and other parts may be connected to each other to form a fuselage and/or wings of an aircraft.

The different structures may be comprised of materials, such as, for example, without limitation, metals, metal alloys, composite materials, and other suitable types of materials. With metals, titanium may be used in different parts. In forming a titanium part, titanium may be deposited onto a substrate to form the part. The substrate may be a titanium plate.

The deposition of metal onto metal plates may be performed using a number of different types of techniques. For example, without limitation, metal may be deposited onto a metal plate using an electron beam deposition system. A metal wire from a feeder may be changed into a molten state with the molten metal being deposited onto the plate.

This type of processing may be performed in near-room temperature environments. The differences in temperature between the molten metal and the plate may lead to stresses in the metal plate. These stresses may result in distortion and peeling of the metal deposited onto the metal plate.

When these distortions occur, the part being formed may need to be reworked and/or scrapped. These situations may increase the time and/or cost needed to manufacture parts. As a result, the assembly and manufacturing of aircraft may need more time and may incur more costs than desired.

Therefore, it would be advantageous to have a method and apparatus that takes into account one or more of the issues discussed above, as well as other possible issues.

SUMMARY

In one advantageous embodiment, a method may be provided for manufacturing an object. A plurality of elements may be positioned to substantially conform to a surface on a first side of a workpiece. The plurality of elements may be heated, while the plurality of elements is substantially conformed to the surface on the first side of the workpiece. A material may be deposited on the workpiece while heating the plurality of elements.

In another advantageous embodiment, a method may be provided for manufacturing an aircraft part. A plurality of elements may be positioned to substantially conform to a surface on a first side of the aircraft part. The surface may comprise a planar surface of a plate and a wall extending from the plate. The aircraft part may be comprised of at least one of a metal, a metal alloy, aluminum, titanium, a plastic, and a composite material. The plurality of elements may be heated, while the plurality of elements is substantially conformed to the surface on the first side of the aircraft part. The plurality of elements may be heated to meet a desired temperature profile selected to reduce distortions in the aircraft part. A material may be deposited on a second side of the aircraft part while heating the plurality of elements. The material may be selected from one of a metal, a metal alloy, titanium, aluminum, a resin, and a plastic. The aircraft part may be turned over. The plurality of elements may be positioned to substantially conform to a surface on the second side of the aircraft part. The first side of the aircraft part may be opposite to the second side of the aircraft part. The plurality of elements may be heated, while the plurality of elements is substantially conformed to the surface on the second side of the aircraft part. The material may be deposited on the first side of the aircraft part while heating the plurality of elements. The desired temperature profile for the aircraft part may be maintained by changing a temperature profile for the plurality of elements by performing at least one of cooling at least a first portion of the plurality of elements and heating at least a second portion of the plurality of elements.

In yet another advantageous embodiment, an apparatus may comprise a plurality of elements configured to move relative to each other, a positioning system, and a heating system. The positioning system may be configured to move the plurality of elements to substantially conform to a surface on a first side of a workpiece in a positioned state. The heating system may be configured to heat the plurality of elements while the plurality of elements is substantially conformed to the surface on the first side of the workpiece.

In still yet another advantageous embodiment, an aircraft part manufacturing system may comprise a plurality of elements configured to move relative to each other, a positioning system, a heating system, and a material deposition system. The positioning system may be configured to move the plurality of elements to substantially conform to a surface on a first side of an aircraft part in a positioned state. The surface of the aircraft part may comprise a planar surface of a plate and a wall extending from the plate. The aircraft part may be comprised of at least one of a metal, a metal alloy, aluminum, titanium, a plastic, and a composite material. The heating system may be configured to heat the plurality of elements while the plurality of elements is substantially conformed to the surface on the first side of the aircraft part to meet a temperature profile selected to reduce distortions in the aircraft part. The plurality of elements may heat the aircraft part such that a difference between a first temperature of the aircraft part and a second temperature of the material is reduced and such that a number of thermal stresses in the aircraft part are reduced. The material deposition system may be configured to deposit a material on the first side of the aircraft part and on a second side of the aircraft part. The material may be selected from one of a metal, a metal alloy, titanium, aluminum, a resin, and a plastic.

The features, functions, and advantages may be achieved independently in various embodiments of the present disclosure or may be combined in yet other embodiments in which further details may be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

Figure 1:
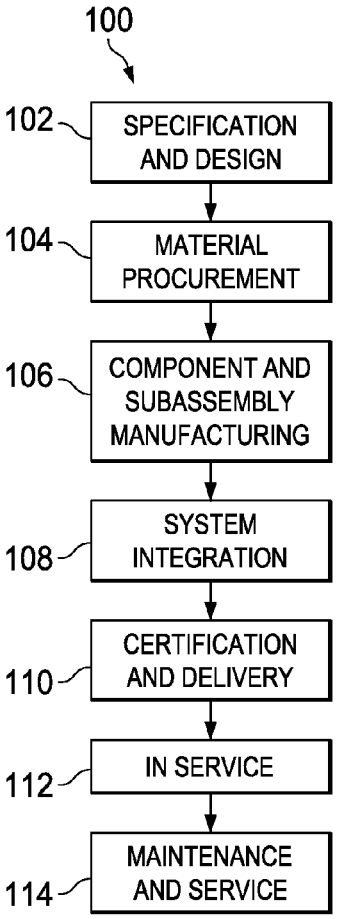
FIG. 1 is an illustration of an aircraft manufacturing and service method in accordance with an advantageous embodiment.
Figure 2:
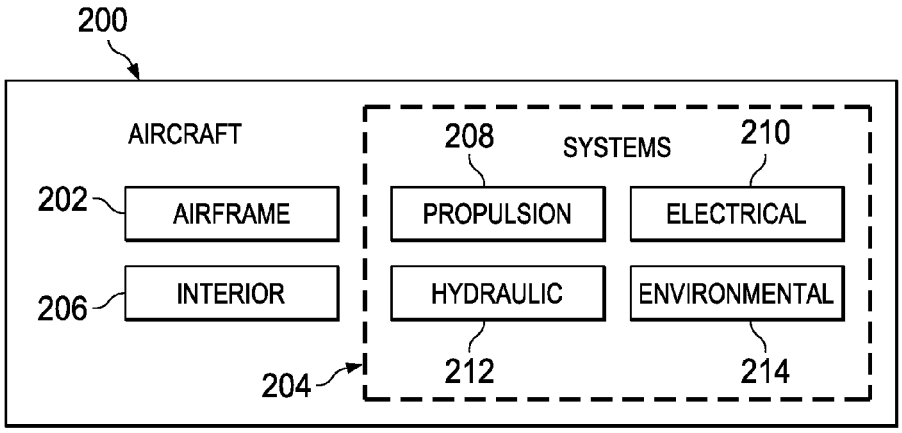
FIG. 2 is an illustration of an aircraft in which an advantageous embodiment may be implemented.

Referring more particularly to the drawings, embodiments of the disclosure may be described in the context of aircraft manufacturing and service method 100 as shown in FIG. 1 and aircraft 200 as shown in FIG. 2. Turning first to FIG. 1, an illustration of an aircraft manufacturing and service method is depicted in accordance with an advantageous embodiment. During pre-production, aircraft manufacturing and service method 100 may include specification and design 102 of aircraft 200 in FIG. 2 and material procurement 104.

During production, component and subassembly manufacturing 106 and system integration 108 of aircraft 200 in FIG. 2 may take place. Thereafter, aircraft 200 in FIG. 2 may go through certification and delivery 110 in order to be placed in service 112. While in service 112 by a customer, aircraft 200 in FIG. 2 may be scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, an illustration of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during at least one of the stages of aircraft manufacturing and service method 100 in FIG. 1. As used herein, the phrase "at least one of", when used with a list of items, means that different combinations of one or more of the listed items may be used and only one of each item in the list may be needed. For example, "at least one of item A, item B, and item C" may include, for example, without limitation, item A, or item A and item B. This example also may include item A, item B, and item C, or item B and item C.

In one illustrative example, components or subassemblies produced in component and subassembly manufacturing 106 in FIG. 1 may be fabricated or manufactured in a manner similar to components or subassemblies produced while aircraft 200 is in service 112 in FIG. 1. As yet another example, a number of apparatus embodiments, method embodiments, or a combination thereof may be utilized during production stages, such as component and subassembly manufacturing 106 and system integration 108 in FIG. 1. A number, when referring to items, means one or more items. For example, a number of apparatus embodiments is one or more apparatus embodiments. A number of apparatus embodiments, method embodiments, or a combination thereof may be utilized while aircraft 200 is in service 112 and/or during maintenance and service 114 in FIG. 1. The use of a number of the different advantageous embodiments may substantially expedite the assembly of and/or reduce the cost of aircraft 200.

The different advantageous embodiments recognize and take into account a number of different considerations. For example, without limitation, the different advantageous embodiments recognize and take into account that distortions in the material deposited on a substrate may be caused by thermal stresses in the substrate. When the material and the substrate take the form of metal, one solution may involve using thicker metal plates. The increased thickness of the metal plate may reduce distortion.

The different advantageous embodiments also recognize and take into account that by using thicker metal plates, the part may be more expensive than desired. Further, the different advantageous embodiments recognize and take into account that a thicker metal plate also may result in a part that may be heavier than desired.

The different advantageous embodiments recognize and take into account that another solution may involve reducing the thermal stress in the metal plate. For example, without limitation, after depositing metal onto the metal plate, the metal plate may be moved from the deposition area to an oven. The oven may heat the metal plate to reduce stress in the metal plate. Thereafter, the metal plate with the material may be returned to the deposition area for additional deposition of materials. This type of process may be performed repeatedly until the part is completed.

The different advantageous embodiments recognize and take into account that this type of solution may take larger amounts of time than desired. Some parts may require one to two days to reduce the thermal stress in a metal plate each time a thermal stress reduction process is performed. This amount of time may increase the time needed to manufacture parts beyond what may be desired.

The different advantageous embodiments recognize and take into account that another solution may involve heating the metal plate on which the metal is deposited. The heating of the metal plate may be performed by placing the metal plate on a heated planar surface that heats the metal plate. The increase in temperature in the metal plate may reduce thermal stresses in the metal plate. As a result, decreases in distortions in the metal deposited on the metal plate may occur.

The different advantageous embodiments recognize and take into account, however, that the use of a planar heating surface may not provide the desired heating for the metal plate. For example, without limitation, the different advantageous embodiments recognize and take into account that after depositing metal on a first side of the metal plate, the metal plate may be flipped over. Additional deposition of metal may then be performed on the second side of the metal plate, which is opposite to the first side.

The different advantageous embodiments recognize and take into account that features on the first side of the metal plate may prevent the desired heating of the metal plate when deposition of material is performed for the second side. For example, without limitation, the features may have a height and/or depth that may prevent the planar heating surface from contacting the metal plate. As a result, the features deposited onto the metal plate may be heated.

Thus, the different advantageous embodiments provide a method and apparatus for processing workpieces. A plurality of elements may be positioned to substantially conform to a surface on a first side of a workpiece. Heating may be performed to heat the plurality of elements, while the plurality of elements may be substantially conformed to the surface of the first side of the workpiece. A material may then be deposited on the workpiece, while heating the plurality of elements.

Figure 3:
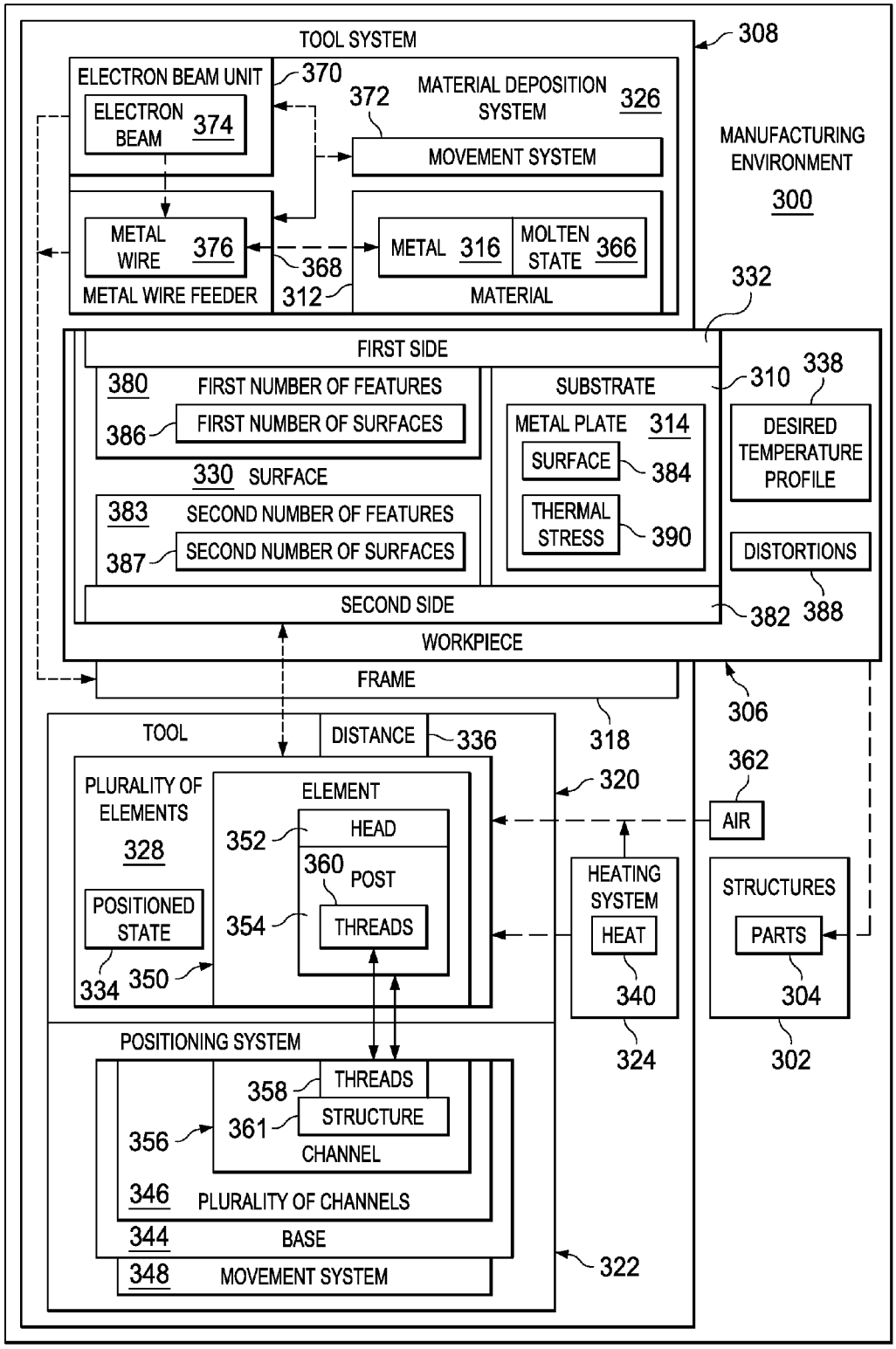
FIG. 3 is an illustration of a manufacturing environment in accordance with an advantageous embodiment.

With reference now to FIG. 3, an illustration of a manufacturing environment is depicted in accordance with an advantageous embodiment. Manufacturing environment 300 may be used to manufacture structures 302 for aircraft 200 in FIG. 2. In these examples, parts 304 may be assembled to form structures 302.

In the different illustrative examples, workpiece 306 may be processed using tool system 308. In these illustrative examples, workpiece 306 may be an object in the process of being worked on and/or processed to form one or more of parts 304.

Workpiece 306 may take the form of substrate 310. Material 312 may be deposited onto substrate 310 using tool system 308. In these illustrative examples, substrate 310 may take the form of metal plate 314. Metal plate 314 may be comprised of at least one of, for example, without limitation, a metal, a metal alloy, aluminum, titanium, plastic, a composite material, and/or some other combination of materials.

In these illustrative examples, material 312 may take the form of metal 316. Metal 316 may be a pure metal, a metal alloy, titanium, aluminum, steel, a nickel alloy, and/or some other suitable type of metal. In other illustrative embodiments, material 312 may take other forms, such as, for example, without limitation, a resin, a plastic, and/or other suitable materials.

As depicted in this example, tool system 308 may comprise frame 318, tool 320, positioning system 322, heating system 324, material deposition system 326, and/or other suitable components. Frame 318 may provide a structure to hold workpiece 306 in these examples.

Tool 320 may comprise plurality of elements 328. Plurality of elements 328 may be configured to move relative to each other. In other words, elements in plurality of elements 328 may all move together and/or individually with respect to other elements in plurality of elements 328. Additionally, elements in plurality of elements 328 may move the same distance and/or different distances as compared to other elements in plurality of elements 328.

Positioning system 322 may be configured to move plurality of elements 328 to substantially conform to surface 330 of workpiece 306 on first side 332 of workpiece 306. When positioned by positioning system 322, plurality of elements 328 may be in positioned state 334. In these illustrative examples, in positioned state 334, plurality of elements 328 may substantially conform to surface 330 and/or touch surface 330.

In other illustrative examples, plurality of elements 328 may not touch surface 330. Instead, each of plurality of elements 328 may be positioned at distance 336 from surface 330 such that heating of plurality of elements 328 may heat workpiece 306 to desired temperature profile 338. Further, distance 336 may not be the same distance for each of plurality of elements 328.

In this manner, different portions of workpiece 306 may be heated to different temperatures to meet desired temperature profile 338. Desired temperature profile 338 may include a specification of temperatures for different portions of workpiece 306. These temperatures may be individual temperatures, temperature ranges, and/or may include tolerances, depending on the particular implementation.

Additionally, desired temperature profile 338 may include a specification of temperatures for different portions of workpiece 306 based on time, locations of the different portions, and/or the particular stage of processing for workpiece 306.

Heating system 324 may generate heat 340 in plurality of elements 328 sufficient to cause workpiece 306 to reach desired temperature profile 338. Material deposition system 326 may deposit material 312 onto workpiece 306.

As illustrated, positioning system 322 may comprise base 344 and movement system 348. Base 344 may have plurality of channels 346. Plurality of channels 346 may be configured to receive plurality of elements 328. Movement system 348 may move plurality of elements 328 within plurality of channels 346.

In these examples, an element, such as element 350 in plurality of elements 328, may comprise head 352 and post 354. Head 352 may be located at an end of post 354. Head 352 may be the portion of element 350 that may be positioned to substantially conform to surface 330 of workpiece 306. Head 352 and post 354 of element 350 may be comprised of materials capable of conducting heat. For example, without limitation, head 352 and post 354 may be comprised of a material selected from at least one of a metal, a metal alloy, ceramic, and/or some other suitable material.

In this illustrative example, post 354 may be received in channel 356 in plurality of channels 346. Channel 356 may have threads 358, and post 354 may have threads 360. Threads 358 in channel 356 may be located in structure 361 within channel 356. Structure 361 may be configured to rotate to cause threads 358 to move relative to threads 360 to cause movement of post 354. In this manner, post 354 may be moved to position head 352 relative to surface 330 in these illustrative examples.

Of course, in other illustrative examples, post 354 may be rotated to move element 350. In still other advantageous embodiments, other mechanisms may be used to move element 350 to position element 350 relative to surface 330 of workpiece 306.

In these illustrative examples, heating system 324 may be connected to plurality of elements 328 to heat plurality of elements 328. As used herein, when a first component is connected to a second component, the first component may be connected to the second component without any additional components. The first component also may be connected to the second component by one or more other components.

For example, without limitation, heating system 324 may be connected to plurality of elements 328 by a heat exchange system that causes air 362 from heating system 324 to heat plurality of elements 328. For example, air 362 may be moved into plurality of elements 328 by heating system 324. Further, heating system 324 may heat air 362 to a desired temperature to heat plurality of elements 328.

In this case, a direct connection between heating system 324 and plurality of elements 328 may not be needed. Instead, a thermal connection may be present instead of a physical connection between heating system 324 and plurality of elements 328.

Heating system 324 may heat, cool, or heat and cool plurality of elements 328, depending on desired temperature profile 338. Further, in other illustrative examples, post 354 may be directly heated by heating system 324 rather than using air 362. In other illustrative examples, heating system 324 may use a liquid or inert gas instead of air 362 to heat plurality of elements 328.

Material deposition system 326 may comprise a number of different systems configured to deposit material 312 onto workpiece 306. In these examples, material deposition system 326 may deposit material 312 onto workpiece 306 in molten state 366.

For example, without limitation, material deposition system 326 may be comprised of metal wire feeder 368, electron beam unit 370, and movement system 372. Movement system 372 may be configured to move metal wire feeder 368 and electron beam unit 370 on frame 318. Electron beam unit 370 may generate electron beam 374 to cause metal wire 376 to reach molten state 366 for deposition onto substrate 310.

In these illustrative examples, as material 312 is deposited onto workpiece 306 on first side 332, first number of features 380 may be formed on surface 330 on first side 332 of workpiece 306. In this illustrative example, surface 330 on first side 332 of workpiece 306 may comprise surface 384 on first side 332 of metal plate 314 and first number of surfaces 386 of first number of features 380. In other words, surface 330 of workpiece 306 may not be a planar surface.

In this manner, plurality of elements 328 may heat both surface 384 of metal plate 314 and first number of surfaces 386 of first number of features 380 to meet desired temperature profile 338. As a result, distortions 388 in workpiece 306 in the form of metal plate 314 may be reduced. The reduction in distortions 388 may occur as a result of a reduction in thermal stress 390 within metal plate 314. In this manner, distortions 388 in material 312 deposited onto workpiece 306 may be reduced.

After forming first number of features 380 on workpiece 306, workpiece 306 may be flipped over to present second side 382 for deposition of material 312. In this position, plurality of elements 328 may be positioned to substantially conform to surface 330 on second side 382 of workpiece 306.

The heating of plurality of elements 328 may occur while material 312 is being deposited onto second side 382 of workpiece 306 to form second number of features 383. Surface 330 on second side 382 of workpiece 306 may comprise surface 384 on second side 382 of metal plate 314 and second number of surfaces 387 of second number of features 383.

The illustration of manufacturing environment 300 in FIG. 3 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, without limitation, in some advantageous embodiments, material deposition system 326 may deposit a powdered metal onto workpiece 306. The powdered metal may then be sintered to form the different features on workpiece 306. In yet other advantageous embodiments, other components also may be present within tool system 308 other than those illustrated. For example, without limitation, a gas environment system also may be included to perform the deposition of material 312. For example, the gas environment system may provide an inert gas that also may be used to heat or cool workpiece 306 and/or material 312.

Figure 4:
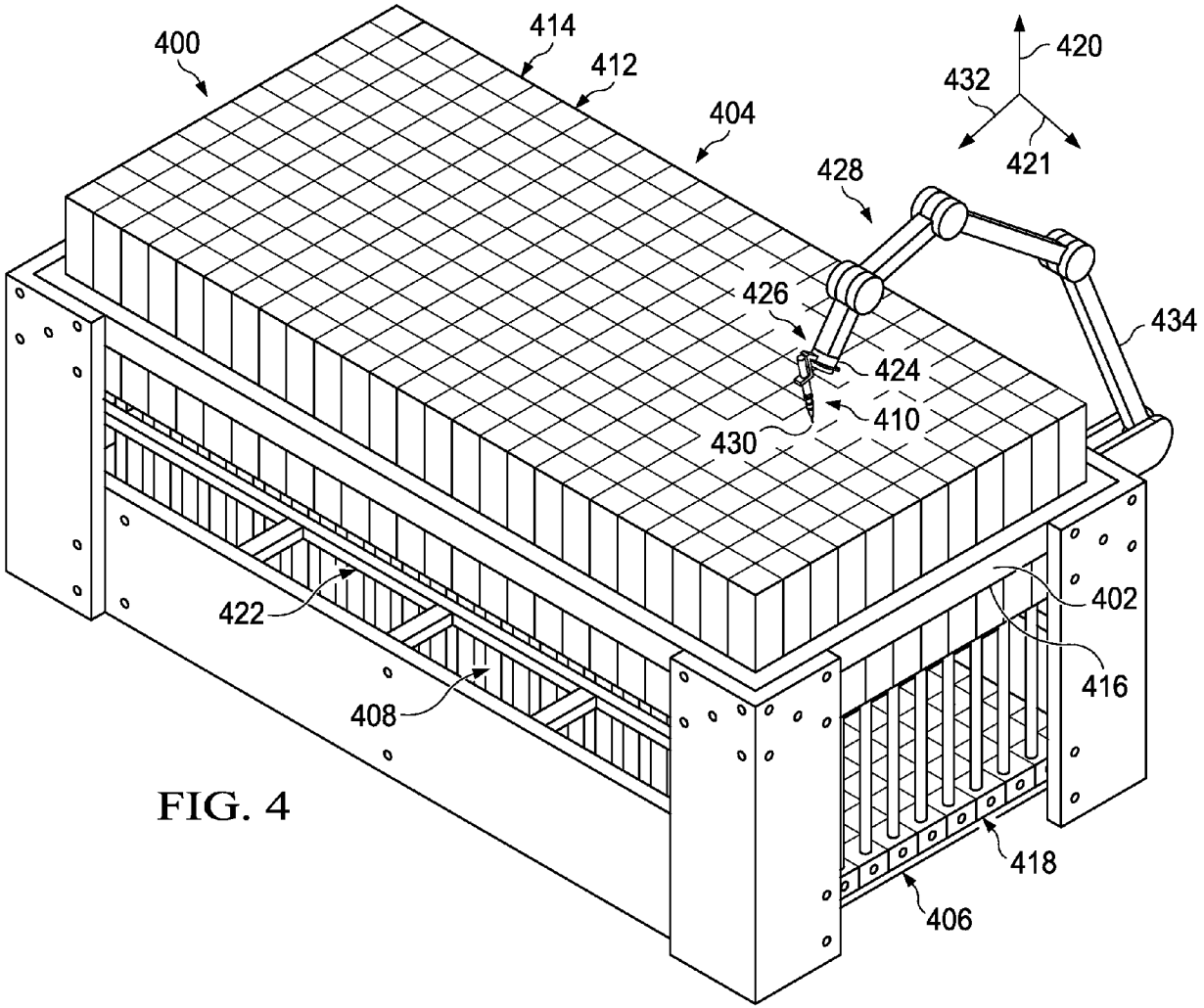
FIG. 4 is an illustration of a perspective view of a tool system in accordance with an advantageous embodiment.

With reference now to FIG. 4, an illustration of a perspective view of a tool system is depicted in accordance with an advantageous embodiment. In this illustrative example, tool system 400 may be an example of one implementation for tool system 308 in FIG. 3. Tool system 400 may include frame 402, tool 404, positioning system 406, heating system 408, and material deposition system 410.

Frame 402 may be configured to hold a workpiece, such as workpiece 306 in FIG. 3. As depicted in this example, tool 404 may comprise plurality of elements 412. Plurality of elements 412 may take the form of plurality of pins 414 in this illustrative example. Each of plurality of pins 414 may have a head with a square shape in this depicted example.

Positioning system 406 may include base 416 and movement system 418. Base 416 may include a plurality of channels (not shown in this view) configured to receive plurality of pins 414. Movement system 418 may be configured to move plurality of pins 414 vertically along axis 420. Plurality of pins 414 may be moved relative to each other. For example, without limitation, movement system 418 may move pins in plurality of pins 414 to the same height or different heights with respect to base 416.

In this illustrative example, heating system 408 may include heat exchange system 422. Heat exchange system 422 may be configured to heat plurality of pins 414 to meet a temperature profile for plurality of pins 414. For example, without limitation, different portions of plurality of pins 414 may be heated to different temperatures. The heating of plurality of pins 414 may allow a workpiece placed on plurality of pins 414 to also be heated to meet a desired temperature profile for the workpiece.

Material deposition system 410 may include metal wire feeder 424, electron beam unit 426, and movement system 428. Metal wire feeder 424 may feed metal wire 430. Electron beam unit 426 may generate an electron beam that may come into contact with metal wire 430. The electron beam may cause metal wire 430 to melt, such that a molten state of the material in metal wire 430 may be deposited on the surface of a workpiece placed on tool 404.

In this illustrative example, movement system 428 may move electron beam unit 426 and metal wire feeder 424 in the directions of axis 420, axis 421, and axis 432. In this manner, material deposition system 410 may be moved over frame 402 for tool system 400 to deposit the material formed from melting metal wire 430 at different locations.

Additionally, movement system 428 may include arm 434. Arm 434 may connect material deposition system 410 to frame 402 for tool system 400.

Figure 5:
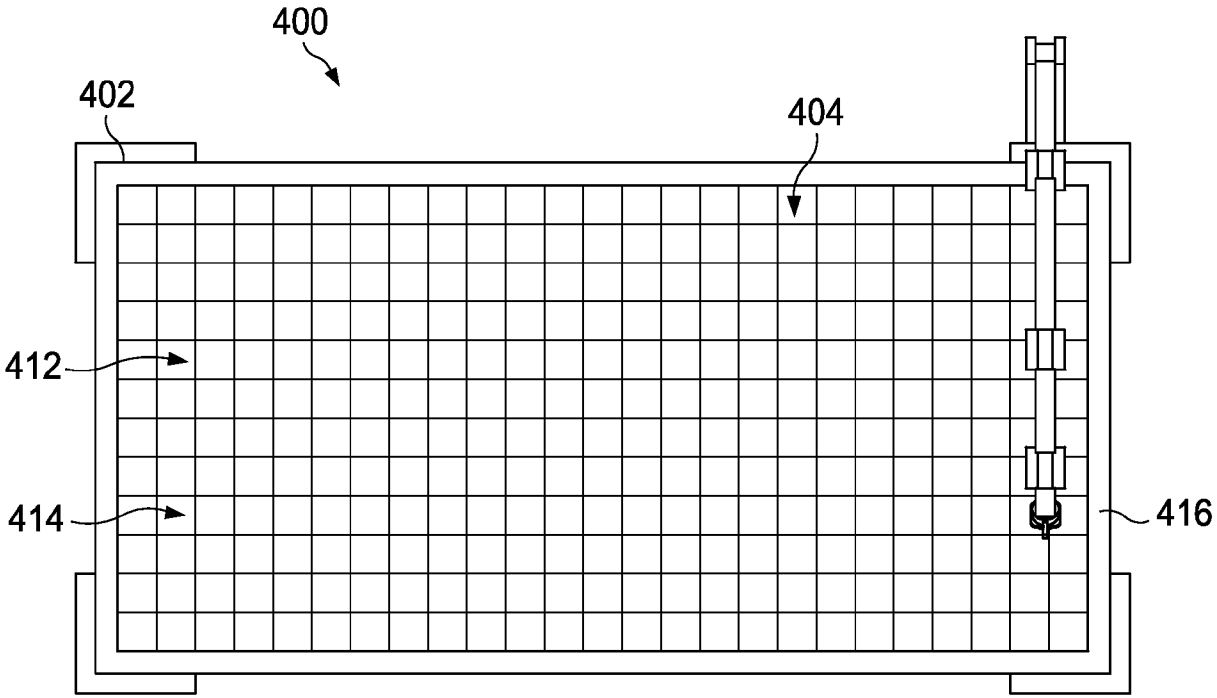
FIG. 5 is an illustration of a top view of a frame and tool for a tool system in accordance with an advantageous embodiment.

With reference now to FIG. 5, an illustration of a top view of a frame and tool for a tool system is depicted in accordance with an advantageous embodiment. In this illustrative example, frame 402 and tool 404 for tool system 400 in FIG. 4 are depicted. Each of plurality of elements 412 may have the same height relative to axis 420 in FIG. 4 in this depicted example.

Figure 6:
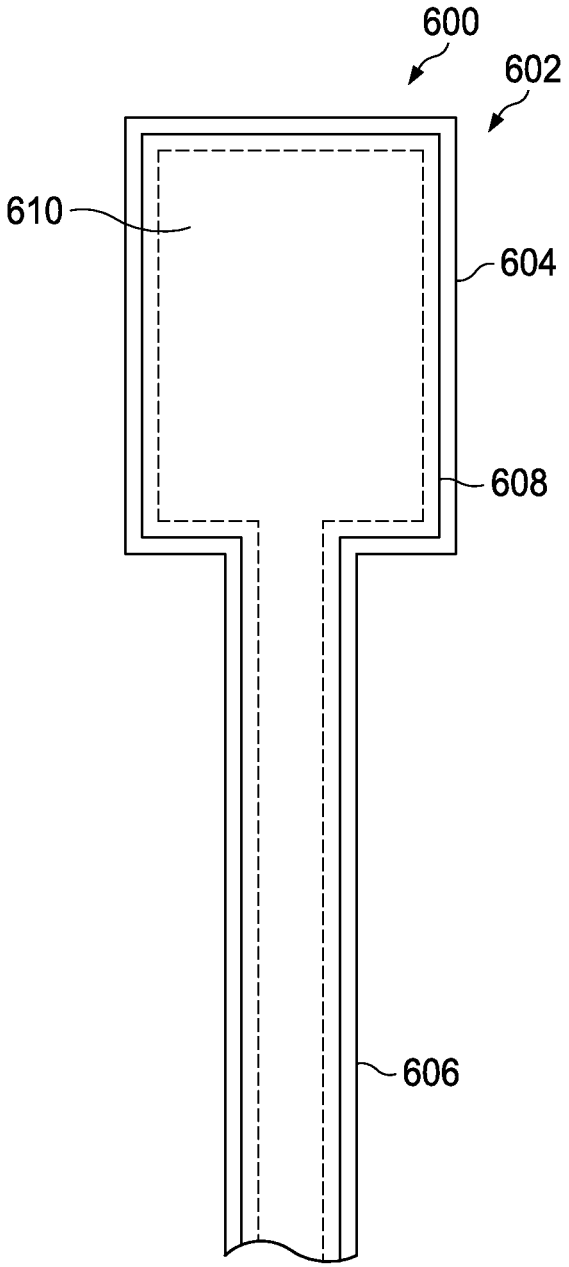
FIG. 6 is an illustration of an element for a tool in a tool system in accordance with an advantageous embodiment.

With reference now to FIG. 6, an illustration of an element for a tool in a tool system is depicted in accordance with an advantageous embodiment. In this illustrative example, element 600 may be an example of an element in plurality of elements 412 in FIG. 4. Element 600 may take the form of pin 602 in plurality of pins 414 in FIG. 4.

As depicted in this example, pin 602 may have head 604 and post 606 connected to head 604. Post 606 may be connected to heating system 408 in FIG. 4. Post 606 may have channel 608. Channel 608 may be configured to receive air 610.

In this illustrative example, air 610 may be air that has been heated to a selected temperature by heating system 408 in FIG. 4. The selected temperature for air 610 may be selected such that pin 602 may be heated and/or cooled to meet a temperature profile for pin 602. In other illustrative examples, a liquid or inert gas may be used instead of air 610 to heat and/or cool pin 602.

The temperature profile for pin 602 may be a specification of the temperature to which pin 602 should be heated based on a number of factors. These factors may include, for example, without limitation, time, a location of pin 602 in plurality of pins 414 in FIG. 4, and/or other suitable factors.

In these depicted examples, other pins in plurality of pins 414 in FIG. 4 may be heated and/or cooled in a similar manner to pin 602.

Figure 7:
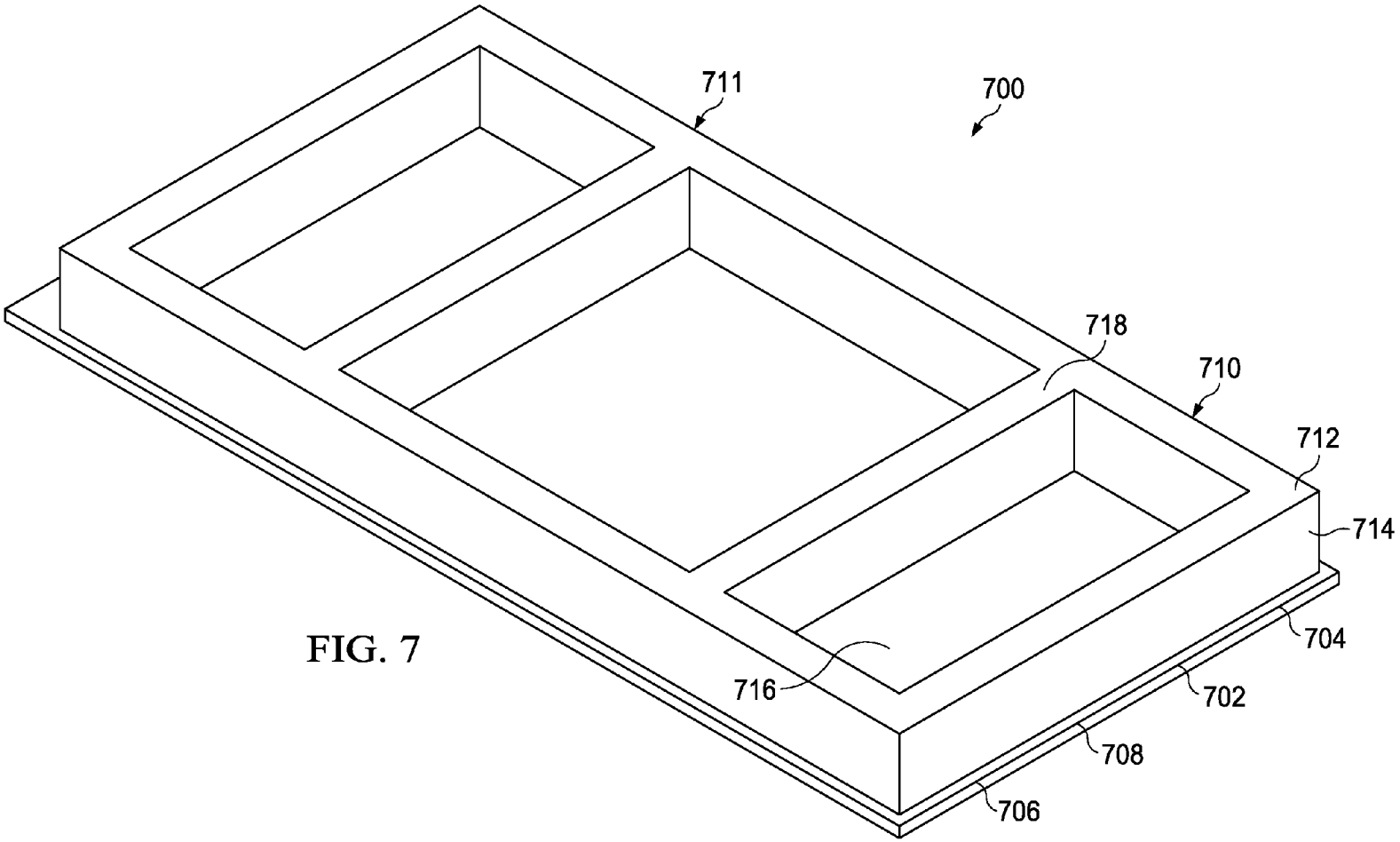
FIG. 7 is an illustration of a partially-processed workpiece in accordance with an advantageous embodiment.

With reference now to FIG. 7, an illustration of a partially-processed workpiece is depicted in accordance with an advantageous embodiment. In this illustrative example, workpiece 700 may be an example of workpiece 306 in FIG. 3. Additionally, workpiece 700 may be an example of a workpiece that may be processed using tool system 400 in FIG. 4.

As depicted in this illustrative example, workpiece 700 may have surface 702 on first side 704 and a second side (not shown in this view) of workpiece 700. Workpiece 700 may take the form of substrate 706 in this depicted example. In particular, substrate 706 may take the form of metal plate 708.

In this illustrative example, features 710 may be formed on surface 702 of workpiece 700. Features 710 may have been formed using tool system 400 in FIG. 4. Features 710 may take the form of walls 711 in this example. Additionally, walls 711 may be comprised of material 712. Material 712 may be metal 714 in this depicted example.

As depicted in this example, surface 702 of workpiece 700 on first side 704 may comprise surface 716 of metal plate 708 and surfaces 718 of walls 711.

Figure 8:
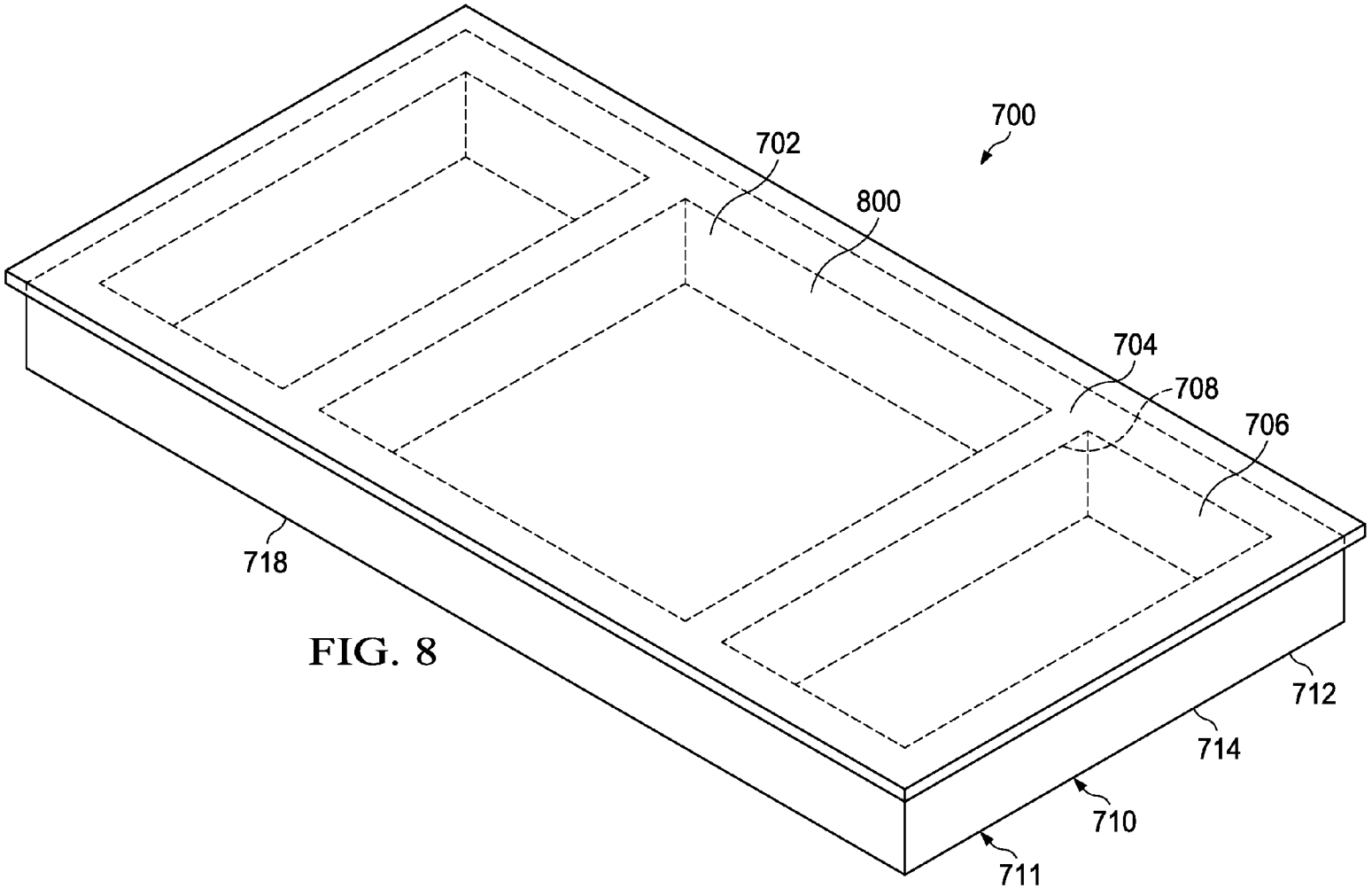
FIG. 8 is an illustration of a partially-processed workpiece in accordance with an advantageous embodiment.

With reference now to FIG. 8, an illustration of a partially-processed workpiece is depicted in accordance with an advantageous embodiment. In this illustrative example, workpiece 700 in FIG. 7 may be depicted turned over such that surface 702 on second side 800 of workpiece 700 may be seen.

Figure 9:
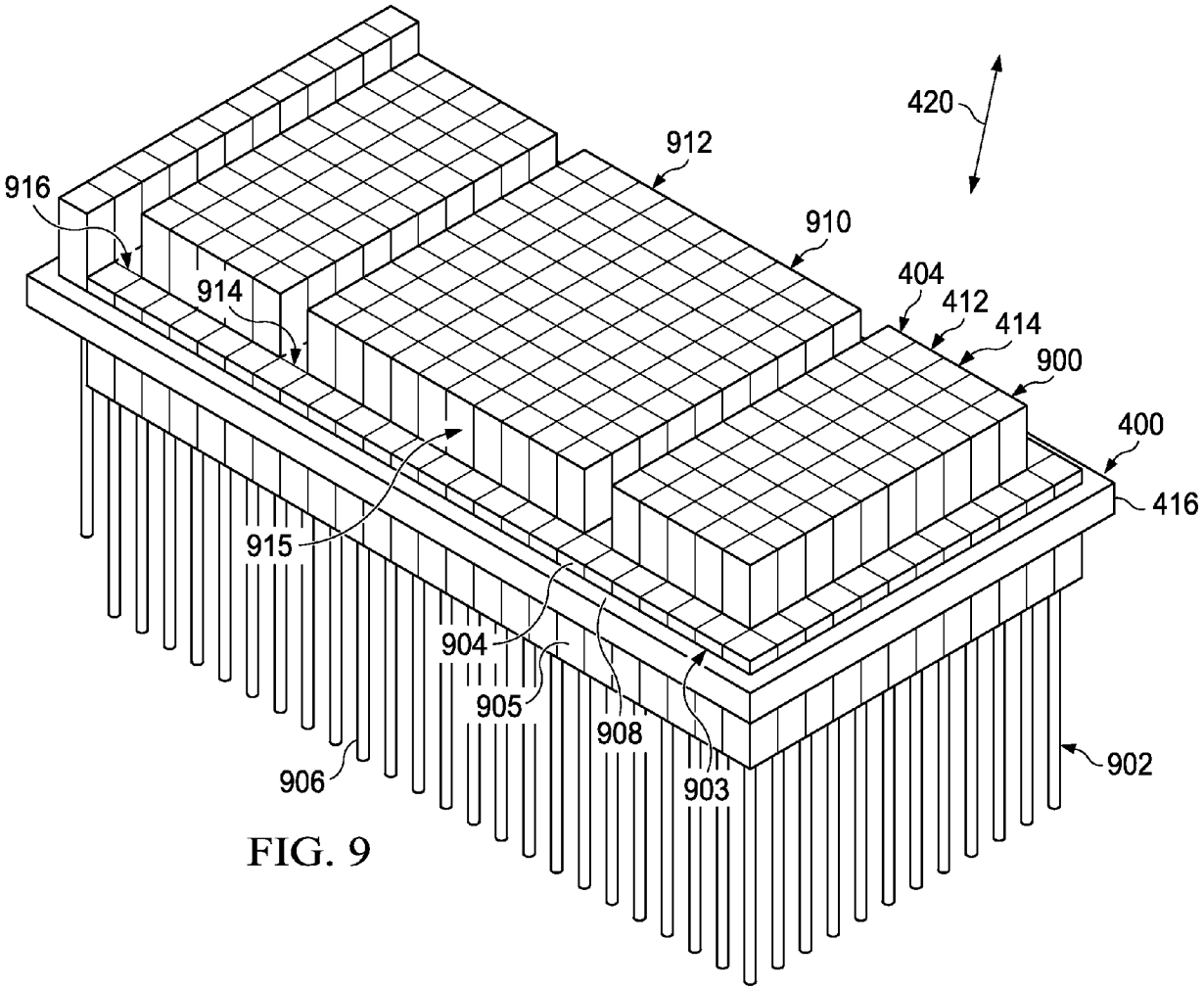
FIG. 9 is an illustration of a portion of a tool system configured for a workpiece in accordance with an advantageous embodiment.

With reference now to FIG. 9, an illustration of a portion of a tool system configured for a workpiece is depicted in accordance with an advantageous embodiment. In this illustrative example, tool 404 for tool system 400 in FIG. 4 may be configured to receive first side 704 of workpiece 700 in FIG. 7. In particular, tool 404 may be configured to receive first side 704 with features 710 on surface 702 of first side 704.

As depicted, plurality of pins 414 may have plurality of heads 900 and plurality of posts 902. Plurality of posts 902 may be configured to move within plurality of channels 903 in base 416. For example, without limitation, pin 904 in plurality of pins 414 may have head 905 and post 906. Pin 904 with head 905 and post 906 may move in the direction of axis 420. Post 906 may move within channel 908 in plurality of channels 903.

In this illustrative example, first portion 910 of plurality of pins 414 may be moved to height 912 relative to base 416. Further, second portion 914 of plurality of pins 414 may be moved to height 916 relative to base 416. With first portion 910 at height 912 and second portion 914 at height 916, plurality of pins 414 may be in positioned state 915. Movement of first portion 910 and second portion 914 of plurality of pins 414 may be performed using positioning system 406 for tool system 400 in FIG. 4.

Height 912 for first portion 910 of plurality of pins 414 may be selected such that first portion 910 may come into contact with surface 716 of metal plate 708 when first side 704 of metal plate 708 in FIG. 7 is placed over plurality of pins 414. Additionally, height 916 for second portion 914 of plurality of pins 414 may be selected such that second portion 914 may come into contact with surfaces 718 of walls 711 in FIG. 7 when first side 704 of metal plate 708 is placed over plurality of pins 414.

In this manner, plurality of pins 414 may be adjusted in height to substantially conform to surface 702 of workpiece 700.

Figure 10:
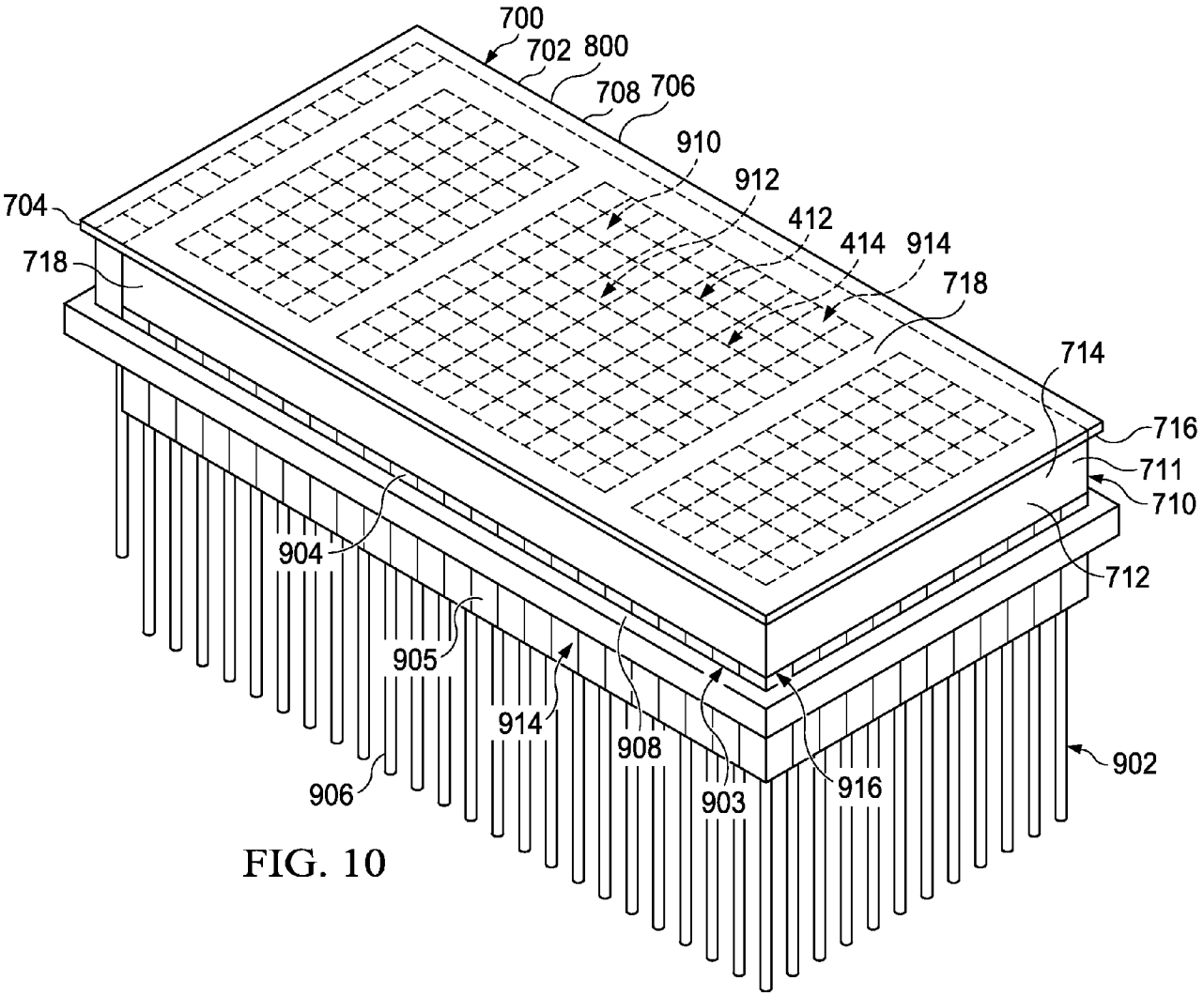
FIG. 10 is an illustration of a phantom view of a workpiece placed on a tool for a tool system in accordance with an advantageous embodiment.

With reference now to FIG. 10, an illustration of a phantom view of a workpiece placed on a tool for a tool system is depicted in accordance with an advantageous embodiment. In this illustrative example, workpiece 700 in FIG. 8 may be placed on tool 404 for tool system 400 in FIG. 9. Metal plate 708 is shown in a phantom view in this example. With this view, the placement of plurality of pins 414 with respect to surface 702 may be more clearly seen.

In this depicted example, plurality of pins 414 may be in positioned state 915 in FIG. 9. In this manner, first side 704 of workpiece 700 may be placed over plurality of pins 414 configured to receive first side 704 of workpiece 700.

As depicted in this illustrative example, first portion 910 of plurality of pins 414 may substantially conform to surface 716 of metal plate 708 when workpiece 700 is placed over tool 404. Further, second portion 914 of plurality of pins 414 may contact surfaces 718 of walls 711 when workpiece 700 is placed over tool 404.

Figure 11:
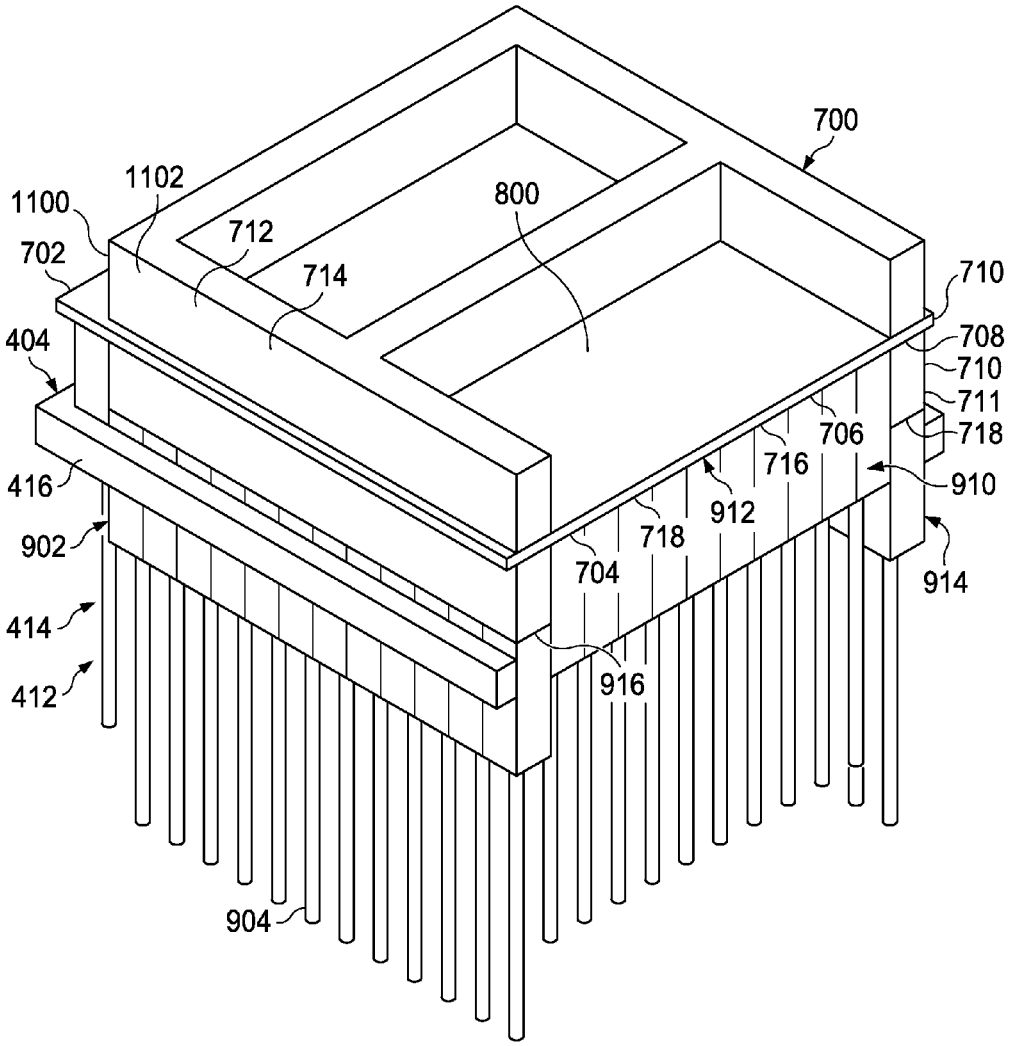
FIG. 11 is an illustration of a cross-sectional view of a workpiece placed on a tool for a tool system in accordance with an advantageous embodiment.

With reference now to FIG. 11, an illustration of a cross-sectional view of a workpiece placed on a tool for a tool system is depicted in accordance with an advantageous embodiment. In this illustrative example, features 1100 have been formed on surface 702 on second side 800 of workpiece 700. Features 1100 may take the form of walls 1102 formed from material 712 in the form of metal 714.

As depicted in this example, at height 912, first portion 910 of plurality of pins 414 may be in contact with surface 716 of metal plate 708. At height 916, second portion 914 of plurality of pins 414 may be in contact with surfaces 718 of walls 711.

Further, first portion 910 may be in contact with all of the sides of walls 711 in this illustrative example. The heads of first portion 910 of plurality of pins 414 may have a length that allows first portion 910 to be in contact with the sides of walls 711.

Figure 12:
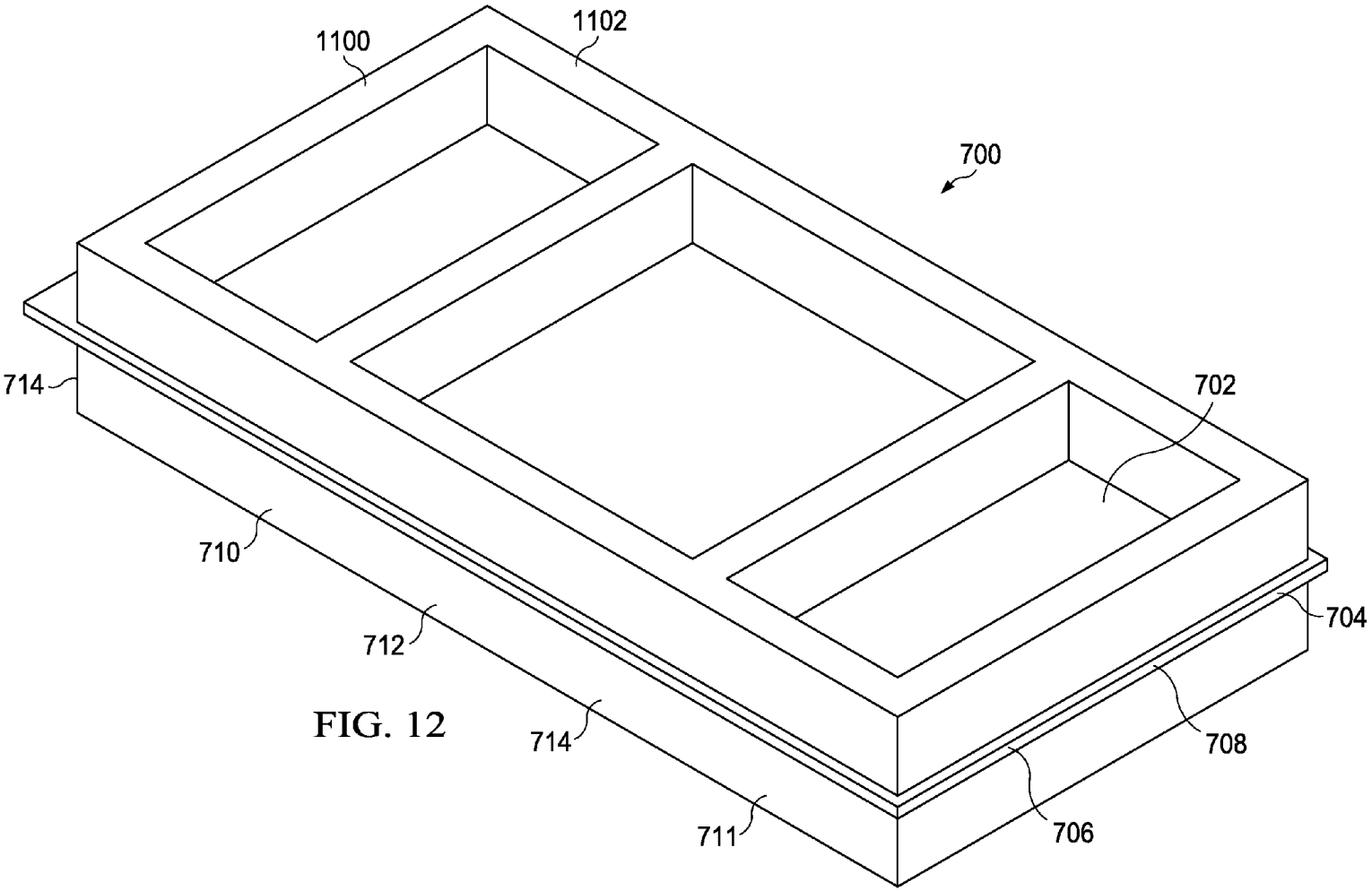
FIG. 12 is an illustration of a fully-processed workpiece in accordance with an advantageous embodiment.

With reference now to FIG. 12, an illustration of a fully-processed workpiece is depicted in accordance with an advantageous embodiment. In this illustrative example, workpiece 700 has been fully processed using tool system 400 in FIG. 4. As depicted, workpiece 700 may have walls 711 and walls 1102 formed on surface 702 of workpiece 700.

Figure 13:
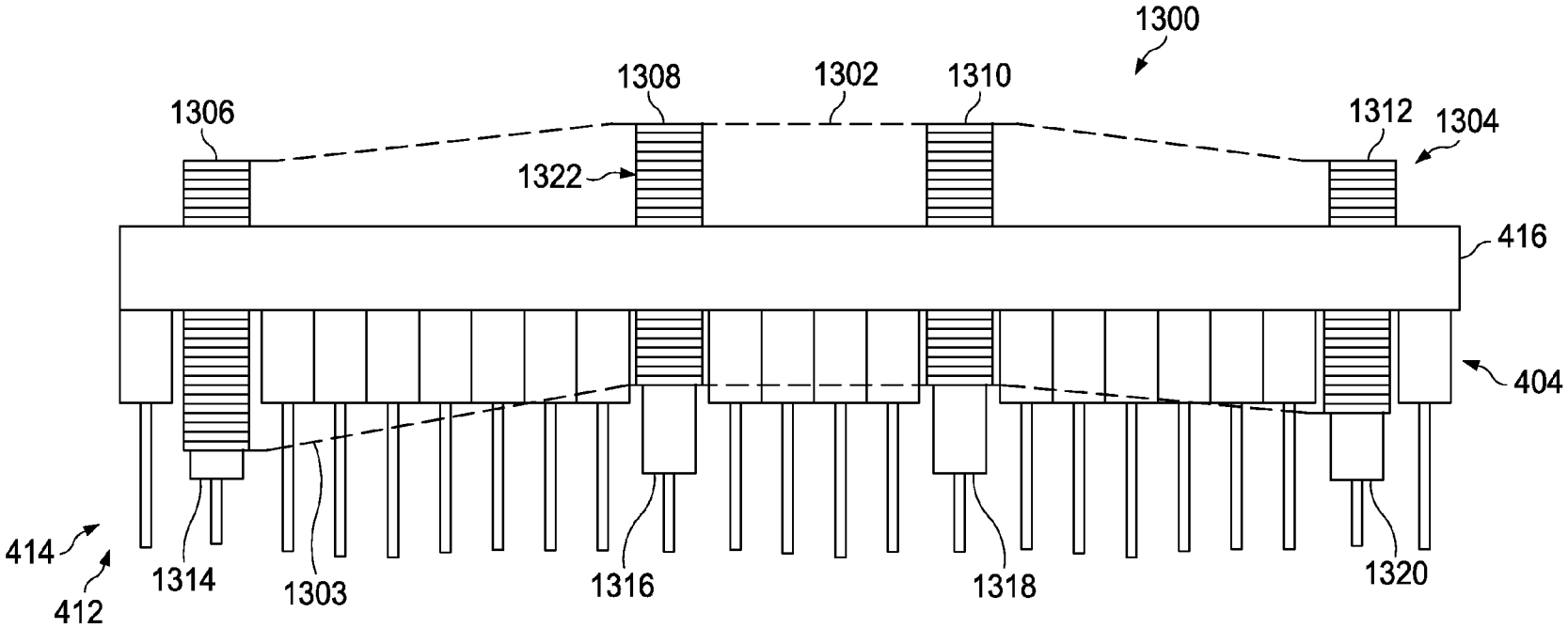
FIG. 13 is an illustration of an exposed cross-sectional view of a workpiece placed on a tool for a tool system in accordance with an advantageous embodiment.

With reference now to FIG. 13, an illustration of an exposed cross-sectional view of a workpiece placed on a tool for a tool system is depicted in accordance with an advantageous embodiment. In this illustrative example, workpiece 1300 may be placed on tool 404 for tool system 400 in FIG. 4.

As depicted, workpiece 1300 may have surface 1302. Surface 1302 may be curved surface 1303. Features 1304 may be formed on surface 1302. Features 1304 may include features 1306, 1308, 1310, and 1312. Pins 1314, 1316, 1318, and 1320 may be adjusted to substantially conform to the surfaces of features 1306, 1308, 1310, and 1312. In this illustrative example, features 1304 may be comprised of layers of metal 1322.

Each of plurality of pins 414 may be adjusted in height such that plurality of pins 414 substantially conform to curved surface 1303. Plurality of pins 414 may be heated to heat workpiece 1300 when plurality of pins 414 are in contact with curved surface 1303 of workpiece 1300.

Figure 14:
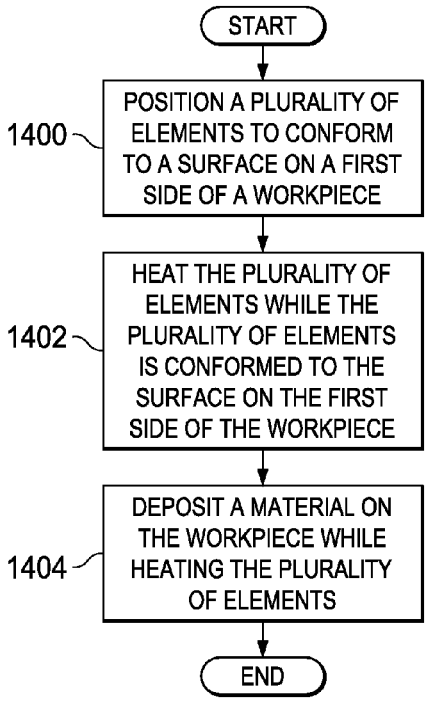
FIG. 14 is an illustration of a flowchart of a process for manufacturing an object in accordance with an advantageous embodiment.

With reference now to FIG. 14, an illustration of a flowchart of a process for manufacturing an object is depicted in accordance with an advantageous embodiment. The process illustrated in FIG. 14 may be implemented using tool system 308 to process workpiece 306 in FIG. 3 to manufacture the object.

The process may begin by positioning plurality of elements 328 to substantially conform to surface 330 on first side 332 of workpiece 306 (operation 1400). Plurality of elements 328 may be part of tool 320 in tool system 308.

Thereafter, plurality of elements 328 may be heated while plurality of elements 328 is substantially conformed to surface 330 on first side 332 of workpiece 306 (operation 1402). The heating of plurality of elements 328 may be performed using heating system 324. Heating plurality of elements 328 may heat workpiece 306 such that workpiece 306 meets desired temperature profile 338.

The process may then deposit material 312 on workpiece 306 while heating plurality of elements 328 (operation 1404), with the process terminating thereafter.

Figure 15:
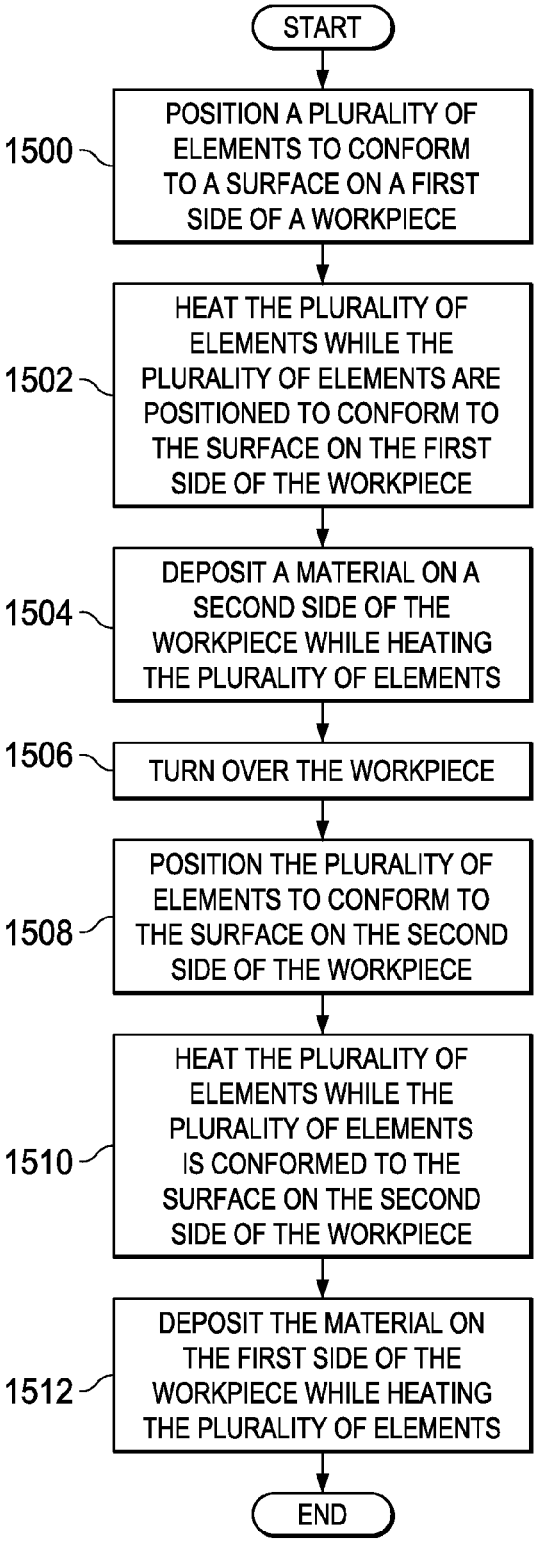
FIG. 15 is an illustration of a flowchart of a process for manufacturing an aircraft part in accordance with an advantageous embodiment.

With reference now to FIG. 15, an illustration of a flowchart of a process for manufacturing an aircraft part is depicted in accordance with an advantageous embodiment. The process illustrated in FIG. 15 may be implemented using tool system 308 to process workpiece 306 in FIG. 3 to manufacture the object. In this illustrative example, workpiece 306 may be an aircraft part.

The process may begin by positioning plurality of elements 328 to substantially conform to surface 330 on first side 332 of workpiece 306 (operation 1500). The process may then heat plurality of elements 328 while plurality of elements 328 are positioned to substantially conform to surface 330 on first side 332 of workpiece 306 (operation 1502).

Thereafter, the process may deposit material 312 on second side 382 of workpiece 306 while heating plurality of elements 328 (operation 1504). Second side 382 may be opposite to first side 332 of workpiece 306. In operation 1504, the deposition of material 312 may form second number of features 383 on second side 382 of workpiece 306.

The process may then turn over workpiece 306 (operation 1506). In operation 1506, workpiece 306 may be turned over to position first side 332 of workpiece 306 for the deposition of material 312.

Next, the process may position plurality of elements 328 to substantially conform to surface 330 on second side 382 of workpiece 306 (operation 1508). For example, without limitation, a first portion of plurality of elements 328 may be positioned at a first height, and a second portion of plurality of elements 328 may be positioned at a second height.

The first height may be selected such that the first portion of plurality of elements 328 may substantially conform to second number of surfaces 387 for second number of features 383. The second height may be selected such that the second portion of plurality of elements 328 may substantially conform to surface 384 of metal plate 314.

The process may heat plurality of elements 328 while plurality of elements 328 is substantially conformed to surface 330 on second side 382 of workpiece 306 (operation 1510). Thereafter, the process may deposit material 312 on first side 332 of workpiece 306 while heating plurality of elements 328 (operation 1512), with the process terminating thereafter.

In this illustrative example, during operations 1504 and 1512, the process may maintain desired temperature profile 338 for workpiece 306 by changing a temperature profile for plurality of elements 328. For example, without limitation, the process may perform at least one of cooling at least a portion of plurality of elements 328 and heating at least a portion of plurality of elements 328.

Figure 16:
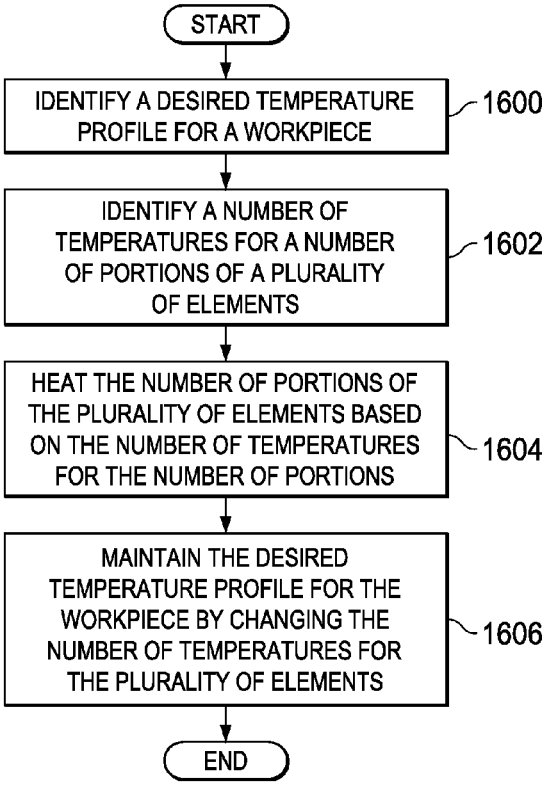
FIG. 16 is an illustration of a flowchart of a process for heating a plurality of elements in accordance with an advantageous embodiment.

With reference now to FIG. 16, an illustration of a flowchart of a process for heating a plurality of elements is depicted in accordance with an advantageous embodiment. The process illustrated in FIG. 16 may be implemented using heating system 324 for tool system 308 to heat plurality of elements 328 in FIG. 3. This process may be implemented to heat workpiece 306 to meet desired temperature profile 338 in FIG. 3.

The process may begin by identifying desired temperature profile 338 for workpiece 306 (operation 1600). Desired temperature profile 338 may include a specification of temperatures for different portions of workpiece 306. These temperatures may be individual temperatures, temperature ranges, and/or may include tolerances, depending on the particular implementation.

Additionally, desired temperature profile 338 may include a specification of temperatures for different portions of workpiece 306 based on time, locations of the different portions, and/or the particular stage of processing for workpiece 306. In this illustrative example, different portions of workpiece 306 may be heated to different temperatures, for example, without limitation.

The process may then identify a number of temperatures for a number of portions of plurality of elements 328 (operation 1602). Each of the number of portions of plurality of elements 328 may include elements that are in contact with a different portion of workpiece 306 to be heated to a particular temperature using desired temperature profile 358.

Thereafter, the process may heat the number of portions of plurality of elements 328 based on the number of temperatures for the number of portions (operation 1604). Operation 1604 may include heating and/or cooling the number of portions of plurality of elements 328 to meet the number of temperatures in desired temperature profile 358. In this manner, workpiece 306 may be heated to desired temperature profile 338.

The process may then maintain desired temperature profile 338 for workpiece 306 by changing the number of temperatures for plurality of elements 328 (operation 1606), with the process terminating thereafter. In operation 1606, elements in plurality of elements 328 may be heated and/or cooled to meet desired temperature profile 338.

Further, in operation 1606, changing the number of temperatures for plurality of elements 328 may include changing the configuration of the number of portions of plurality of elements 328 and/or the temperature to which each of the number of portions of plurality of elements 328 is heated. Operation 1606 may be performed until processing of the workpiece is completed.

The flowcharts and block diagrams in the different depicted embodiments illustrate the architecture, functionality, and operation of some possible implementations of apparatus and methods in different advantageous embodiments. In this regard, each block in the flowcharts or block diagrams may represent a module, segment, function, and/or a portion of an operation or step.

In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

For example, without limitation, in FIG. 15, operation 1502 and operation 1504 may be performed at the same time. Similarly, operation 1508 and operation 1510 may be performed at the same time.

Thus, the different advantageous embodiments provide a method and apparatus for processing workpieces. A plurality of elements may be positioned to substantially conform to a surface on a first side of a workpiece. Heating may be performed to heat the plurality of elements, while the plurality of elements is substantially conformed to the surface of the first side of the workpiece. A material may then be deposited on the workpiece, while heating the plurality of elements.

The different advantageous embodiments may provide a method and apparatus for processing workpieces that may take less time and/or effort. Further, the cost of processing the workpieces may be reduced.

The description of the different advantageous embodiments has been presented for purposes of illustration and description and is not intended to be exhaustive or limited to the embodiments in the form disclosed. Many modifications and variations will be apparent to those of ordinary skill in the art. Further, different advantageous embodiments may provide different advantages as compared to other advantageous embodiments.

The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for manufacturing an object, the method comprising:

positioning a plurality of elements to substantially conform to a surface on a first side of a workpiece;

heating the plurality of elements while the plurality of elements is substantially conformed to the surface on the first side of the workpiece;

depositing a material on the workpiece while heating the plurality of elements while the plurality of elements is substantially conformed to the surface on the first side of the workpiece, wherein depositing the material on the workpiece comprises forming a number of features on a second side of the workpiece such that a surface on the second side of the workpiece comprises the number of features and the surface on the second side of the workpiece is a non-planar surface after deposition;

turning over the workpiece;

positioning the plurality of elements to substantially conform to the surface on the second side of the workpiece; and depositing the material on the first side of the workpiece, while heating the plurality of elements, while the plurality of elements is substantially conformed to the surface on the second side of the workpiece.

2. The method of claim 1, wherein the step of heating the plurality of elements, while the plurality of elements is substantially conformed to the surface on the first side of the workpiece comprises:

heating the plurality of elements, while the plurality of elements is substantially conformed to the surface on the first side of the workpiece, wherein the plurality of elements is heated to meet a temperature profile selected to reduce distortions in the workpiece.

3. The method of claim 1, wherein the first side of the workpiece is opposite to the second side of the workpiece.

4. The method of claim 1 further comprising:

waiting for a period of time; and depositing an additional material on the workpiece after the period of time.

5. The method of claim 1 further comprising:

heating the plurality of elements, while the plurality of elements is substantially conformed to the surface on the second side of the workpiece.

6. The method of claim 1 further comprising:

measuring a distortion in the workpiece after depositing the material.

7. The method of claim 1, wherein the surface on the second side of the workpiece comprises a planar surface of a plate and a wall extending from the plate.

8. The method of claim 1, wherein the workpiece is comprised of at least one of a metal, a metal alloy, aluminum, titanium, a plastic, and a composite material.

9. The method of claim 1, wherein the material is selected from one of a metal, a metal alloy, titanium, aluminum, a resin, and a plastic.

10. The method of claim 1, wherein the workpiece is an aircraft part.

11. The method of claim 1, wherein heating the plurality of elements while the plurality of elements is substantially conformed to the surface on the first side of the workpiece heats the workpiece during the depositing of the material on the workpiece.

12. The method of claim 1 further comprising:

maintaining a desired temperature profile for the workpiece by changing a temperature profile for the plurality of elements.

13. The method of claim 12, wherein the maintaining step comprises:

cooling at least a portion of the plurality of elements.

14. The method of claim 12, wherein the maintaining step comprises:

heating at least a portion of the plurality of elements.

15. The method of claim 12, wherein the desired temperature profile for the workpiece includes a specification of temperatures of different portions of the workpiece, wherein different portions of the workpiece are heated to different temperatures.

16. A method for manufacturing an aircraft part, the method comprising:

positioning a plurality of elements to substantially conform to a surface on a first side of the aircraft part in which the surface comprises a planar surface of a plate and a wall extending from the plate and in which the aircraft part is comprised of at least one of a metal, a metal alloy, aluminum, titanium, a plastic, and a composite material;

heating the plurality of elements, while the plurality of elements is substantially conformed to the surface on the first side of the aircraft part in which the plurality of elements is heated to a temperature profile to cause a desired temperature profile in the aircraft part selected to reduce distortions in the aircraft part; and depositing a material on a second side of the aircraft part, while heating the plurality of elements while the plurality of elements is substantially conformed to the surface on the first side of the aircraft part, in which the material is selected from one of the metal, the metal alloy, the titanium, the aluminum, a resin, and the plastic, wherein depositing the material on the second side of the aircraft part comprises forming a number of features on the second side of the aircraft part such that the surface on the second side of the aircraft part comprises the number of features and the surface on the second side of the workpiece is a non-planar surface after deposition;

turning over the aircraft part;

positioning the plurality of elements to substantially conform to a surface on the second side of the aircraft part in which the first side of the aircraft part is opposite to the second side of the aircraft part;

heating the plurality of elements, while the plurality of elements is substantially conformed to the surface on the second side of the aircraft part;

depositing the material on the first side of the aircraft part while heating the plurality of elements while the plurality of elements is substantially conformed to the surface on the second side of the aircraft part; and maintaining the desired temperature profile for the aircraft part by changing the temperature profile for the plurality of elements by performing at least one of cooling at least a first portion of the plurality of elements and heating at least a second portion of the plurality of elements.

17. The method of claim 16, wherein the desired temperature profile for the aircraft part includes different temperatures.

18. The method of claim 16, wherein heating the plurality of elements while the plurality of elements is substantially conformed to the surface on the first side of the aircraft part heats the aircraft part during the depositing of the material on the second side of the aircraft part.

* * * * *